US007213528B1

(12) United States Patent
Pendergraph

(10) Patent No.: US 7,213,528 B1
(45) Date of Patent: May 8, 2007

(54) BULKHEAD DOOR FOR A VESSEL

(75) Inventor: David E. Pendergraph, Auburn, NY (US)

(73) Assignee: Performance by Design International, Inc., Auburn, NY (US)

( * ) Notice: Subject to any disclaimer, the term of this patent is extended or adjusted under 35 U.S.C. 154(b) by 2 days.

(21) Appl. No.: 11/217,911

(22) Filed: Sep. 1, 2005

Related U.S. Application Data

(60) Provisional application No. 60/607,020, filed on Sep. 3, 2004.

(51) Int. Cl.
*B63B 3/56* (2006.01)

(52) U.S. Cl. ..... 114/78

(58) Field of Classification Search ..... 114/78
See application file for complete search history.

(56) References Cited

U.S. PATENT DOCUMENTS 5,199,369 A * 4/1993 Meyer et al. ..... 114/117
6,003,461 A * 12/1999 Blanchette et al. ..... 114/117
6,341,450 B1 * 1/2002 Macander et al. ..... 52/20

* cited by examiner

*Primary Examiner*—Stephen Avila
(74) *Attorney, Agent, or Firm*—Neal L. Slifkin; Robert C. Brown

(57) ABSTRACT

A bulkhead door for watertight closing of a bulkhead opening of a naval vessel, comprising a composite outer shell and inner shell, a chamber therebetween, and a channel along the door margin for retaining a gasket without adhesive. The chamber may be filled with a material such as a rigid foam to increase door strength and rigidity. The outer shell includes hinge blades spaced apart by a standard distance and spaced equally from ends of the door, so that each door may be used for either a right-hand or left-hand bulkhead hinge pin orientation. Metal strikers are bonded to the outer surface of the door for engaging closure dogs in use. A door may be provided without any strikers, and the strikers then bonded to the door at appropriate locations during installation of a door to a specific bulkhead opening location.

15 Claims, 3 Drawing Sheets

BULKHEAD DOOR FOR A VESSEL

RELATIONSHIP TO OTHER APPLICATIONS AND PATENTS

The present application draws priority from a pending U.S. Provisional Patent Application Ser. No. 60/607,020, filed Sep. 3, 2004.

TECHNICAL FIELD

The present invention relates to doors for bulkheads on vessels; more particularly, to bulkhead doors which can be sealed against passage of water and gas; and most particularly, to an improved bulkhead door formed of multi-material composites and having universal hinge and handle features and superior capture and retention of a sealing gasket without adhesives.

BACKGROUND OF THE INVENTION

Bulkhead doors are well known on naval vessels. As used herein, "bulkhead door" should be taken to mean a sealable door installed in a vertical surface (bulkhead door), horizontal surface ("hatch cover"), or a door-within-a-door ("scuttle"). A typical prior art bulkhead door includes a resilient gasket that mates with an edge of a collar surrounding a bulkhead opening and extending from the bulkhead outer surface. In sealing use of a bulkhead door, a plurality of pivotable latches, known in the art as "dogs", are mounted on the bulkhead and may be pivoted into position against the outer surface of the door where they progressively engage wedged elements, known in the art as "strikers". Such progressive engagement causes the gasket to be compressed against the collar edge, sealing the bulkhead opening against water and/or gas transmission.

Prior art bulkhead doors have several disadvantages. Such doors typically are formed of sheet steel and are relatively heavy, for example, about 125 pounds. Navy regulations require that a door or hatch cover may require no more than a maximum of 50 pounds of force to open; thus, many doors and hatches require helper springs to partially offset the weight of a steel door.

Being formed of steel, prior art doors are vulnerable to rust, especially under saltwater exposure, requiring that the lower door edges and gasket channels be reconstructed relatively often, requiring welding and grinding. Prior art inventoried doors also tend to be inconsistent in their manufacture. Thus each door must be custom-fitted to its respective bulkhead opening to assure watertight and gastight sealing performance, which fitting typically requires grinding and/or welding ("hot work") and is a generally "dirty" operation. When hot work or an open flame is required during maintenance of a vessel, naval regulations require a large force of fire security personnel to be present not only on the deck on which the work is conducted but also on the decks immediately above and below the work. The Navy estimates that 1000 manhours are required for maintenance of a single door during the service life of a vessel.

Prior art doors typically are formed by stamping from sheet metal and include a stamped relief pattern to enhance flexural rigidity. It has been found that such a pattern is highly undesirable, for two reasons: first, the pattern greatly increases radar reflection from the door, thus aiding an enemy; and second, the pattern is difficult to wash down easily and thoroughly as may be required for washdown of a chemical spill or biochemical attack. For these considerations, a smooth surface is preferred.

Typically, many of the bulkhead openings in a ship are identical in height, width, and shape. However, a ship typically is outfitted with a mixture of left-hinge and right-hinge bulkhead openings, requiring doors having corresponding right- and left-oriented hinge blades and door handles. Further, the openings may vary between 2 and 10 in the number of dogs provided for engaging a bulkhead door, requiring an equivalent number and placement of strikers on the door. Thus, in the prior art, although bulkhead openings may be identical, the required doors are not. Therefore, a naval vessel carries an extensive, expensive, and heavy inventory of spare doors to cover all possible replacement contingencies.

This cumbersome inventory is made worse by the need on many ships to cover a variety of naval door opening sizes, for example, 26×66 inches and 26×63 inches, both left and right hinged, each with possibly 3, 6, 8, or 10 dogs; and 18×36 inches, both left and right hinged (a scuttle door), having 2, 4, or 6 dogs.

Further, in prior art bulkhead doors, the resilient gasket is not well-captured by the door and require adhesives for retention in a gasket channel. Further, the gasket is exposed to attack by fire, which can result in sealing failure of the door. Further, replacement of a deteriorated gasket requires laborious and time-consuming scraping off of the old gasket and adhesives and re-preparation of the door surface for receiving the new gasket and adhesive.

What is needed in the art is a universal bulkhead door that eliminates exposed metal dogs on the exterior of the door, has a smooth surface on both the interior and exterior of the door, provides consistent lockdown pressure across the door, shields the door gasket from attack by fire, is readily and cleanly washed down, may be opened easily without helper springs in a hatch mode, provides for simple replacement of a door gasket, and may itself be easily replaced without requiring hot work.

It is a principal object of the present invention to reduce the inventory of spare bulkhead doors which must be carried on a naval vessel.

It is a further object of the invention to reduce the weight of a bulkhead door.

It is a still further object of the invention to protect a bulkhead door gasket from exposure to fire.

It is a still further object of the invention to simplify replacement of a bulkhead door gasket.

SUMMARY OF THE INVENTION

Briefly described, an improved bulkhead door in accordance with the invention comprises an outer shell and an inner shell formed as by molding of a strong, durable material such as a multi-material composite that may include carbon fiber and organic polymers as well as inorganic materials. The molded shells are bonded together along their peripheries to form a core chamber therebetween and a continuous cove channel along the margin of the door for receiving, retaining without adhesive, and protecting a resilient gasket. The molded cove channel also increases the flexural rigidity of the door. Either or both of the shells may be ribbed within the core chamber which may be filled with another material such as a rigid foam for additional strength and increased rigidity of the door.

The outer shell is provided with a molded handle and with hinge blades spaced apart by a standard distance, the handle and each blade being spaced by equal distances from an end of the door. Thus each door may be used for either a right-hand or left-hand bulkhead hinge pin orientation. The handle may be centered in the door, such that all door, either left or right opening, have their handles in the same place. However, for use as hatch covers, the handle may be laterally offset from the hinges although still equidistant from the door ends. Metal strikers are bonded to the outer surface of the door for engaging closure dogs in use. A door may be provided with the maximum number of strikers in use on a door on a particular vessel, or alternatively, a door may be provided without any strikers, and the strikers then bonded to the door at appropriate locations during installation of a door to a specific bulkhead opening location.

A bulkhead door in accordance with the invention improves on the prior art by reducing the number and variety of spare doors required on a naval vessel; reducing required door maintenance over the working lifetime of a bulkhead door; eliminating rust; eliminating time-consuming and dirty fitting of a new door to an existing bulkhead opening; increasing hinge life, striker life, and bushing life through reduced swing weight; improving personnel egress when the bulkhead opening and door comprise a deck hatch; providing increased chemical resistance; providing smooth exterior and interior surfaces for enhanced chemical and biochemical washdown; and providing an easily removable emergency flotation device.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
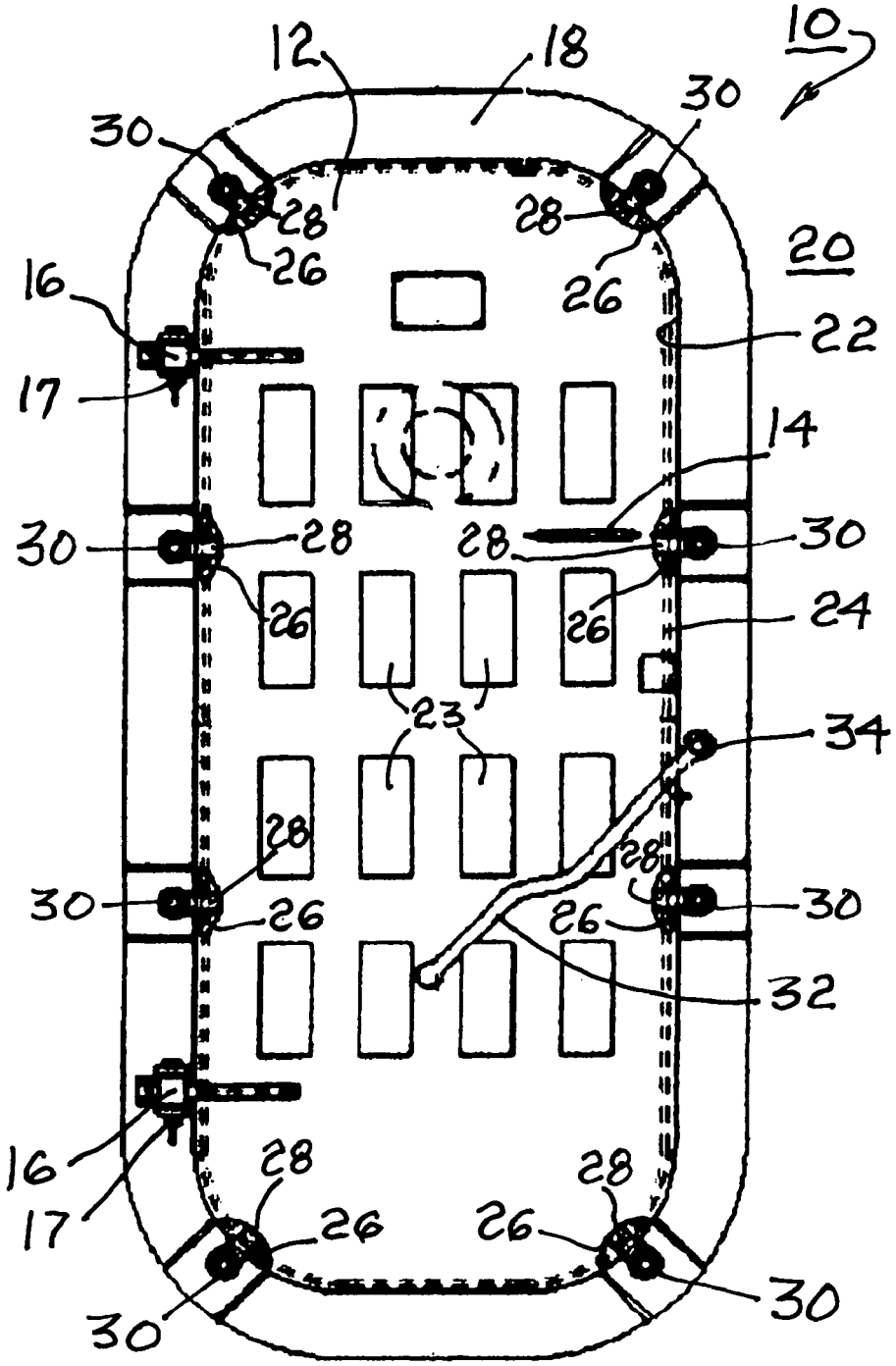
FIG. 1 (PRIOR ART)
FIG. 1 is an elevational exterior view of a prior art watertight bulkhead door system, showing a plurality of pivotable dogs (eight) for securing the door against a collar surrounding a bulkhead opening.
Figure 2:
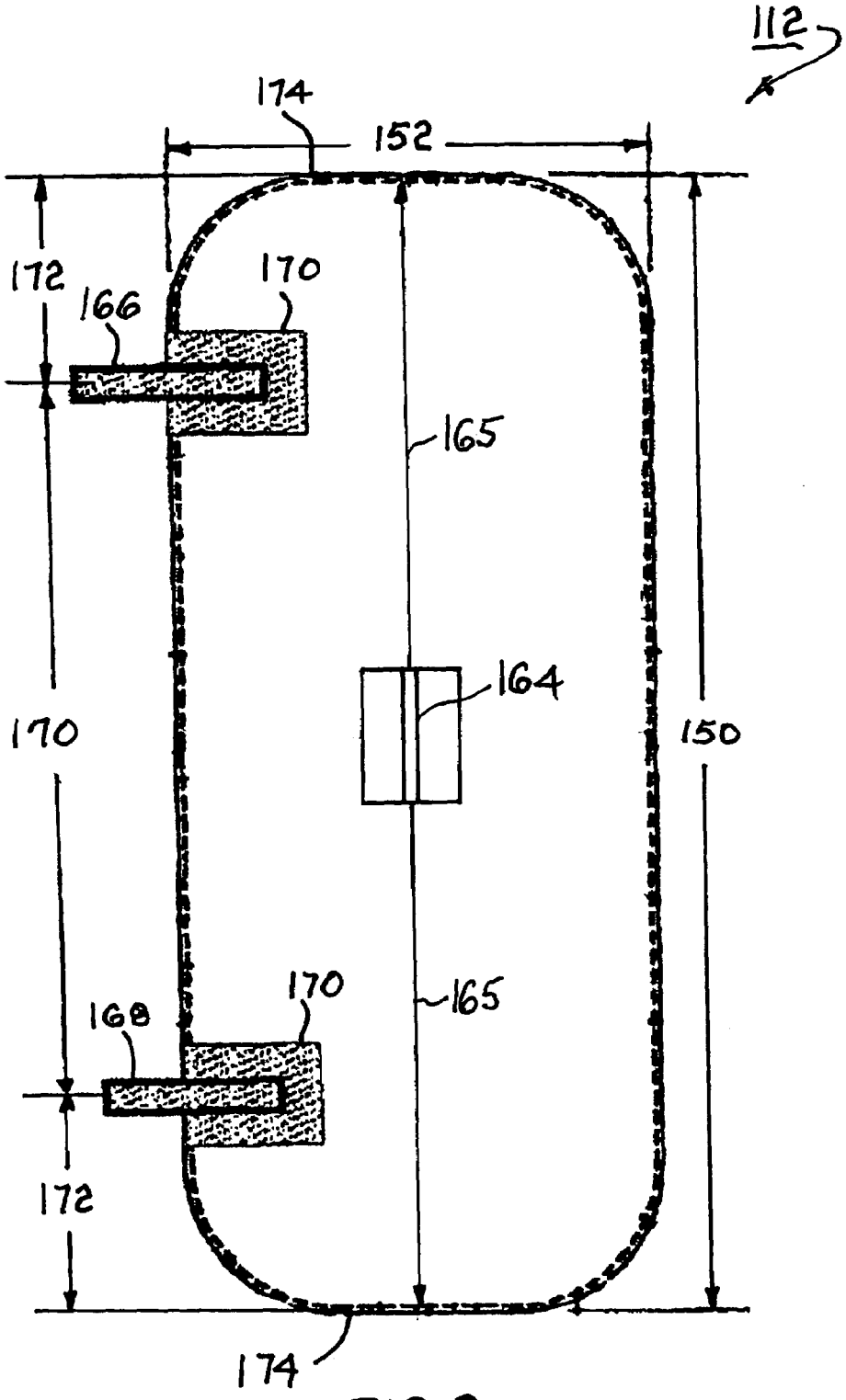
FIG. 2 is an elevational view of a bulkhead door in accordance with the invention.
Figure 3:
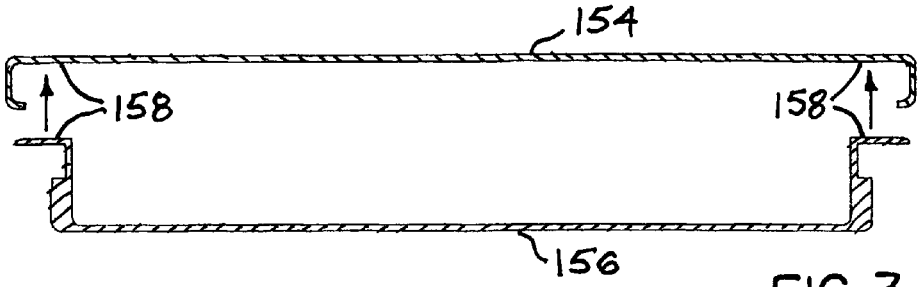
FIG. 3 is an exploded cross-sectional view of the bulkhead door shown in FIG. 2, showing outer and inner door shells.
Figure 4:
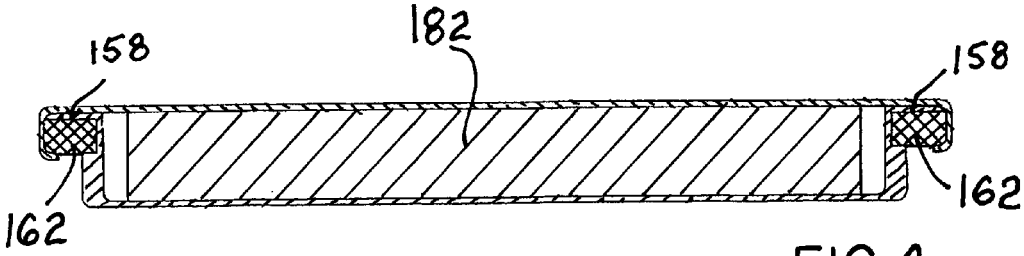
FIG. 4 is an assembled cross-sectional view of the bulkhead door shown in FIGS. 2 and 3, showing capture of a sealing gasket in a cove channel thereof.
Figure 5:
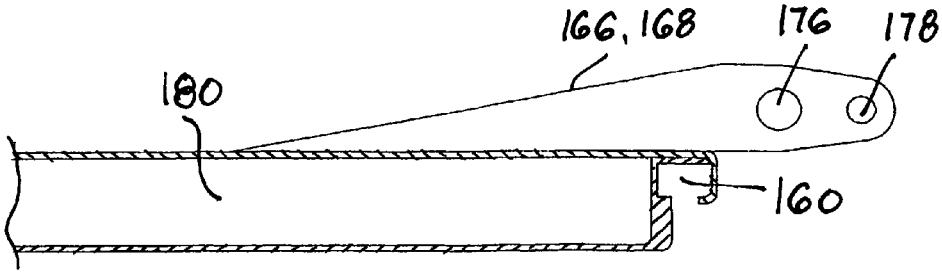
FIG. 5 is a cross-sectional view taken along line 5—5 in FIG. 2, showing an integral hinge blade.

Referring to FIG. 1, a prior art watertight bulkhead door system 10 comprises a bulkhead door 12 provided with a handle 14, hinges 16, and hinge pins 17 mounted to a collar 18 attached to an exterior surface of a bulkhead 20 and surrounding a bulkhead opening 22. Prior art door 12 includes a pattern of stampings 23 to increase flexural rigidity and continuous peripheral gasket 24 disposed on a reverse side of door 12 for sealingly mating with a collar 18 extending away from the exterior bulkhead surface. System 10 is shown in door closed and locked position.

The peripheral surface of door 12 is provided with a plurality of strikers 26 tapered in a direction generally parallel with the sides of door 12. An equal number of dogs 28 are pivotably disposed, one for each striker, outboard of door 12 in collar 18. Dogs 28 are mounted on spindles 30 extending through collar 18 and bulkhead 20, the spindles being synchronously rotatable by an articulated mechanism (not visible in FIG. 1) surrounding opening 22 on the interior of bulkhead 20. The mechanism comprises a linkage of spindles, connecting rods, and bellcranks, manually actuable by a master lever 32 mounted on a pivotable spindle 34 extending through collar 18 and bulkhead 20 as a component of the articulated mechanism. Lever 32 has a counterpart (not visible) on the interior of bulkhead 20.

Prior art door 12 is typically formed from sheet steel as by stamping from sheet stock and may weigh typically about 125 pounds.

In operation of prior art system 10, starting in an open position, rotation of lever 32 in a first direction causes dogs 28 to be rotated on their individual spindles 30 into overlapping relationship with strikers 26 whereby each dog 28 engages the wedged surface of its respective striker 26. Continued rotation of dogs 28 on the striker wedged surfaces urges door 12 toward bulkhead 20, causing the gasket to be compressed against the collar flange. Opening of system 10 is the reverse of closing.

Referring to FIGS. 2 through 5, an improved watertight bulkhead door 112 has the same height 150, width 152, and shape as prior art door 12 such that improved door 112 can directly replace prior art door 12 without requiring any custom fitting or hot work. Door 112 is formed of an outer door shell 154 and an inner door shell 156 (FIG. 3) which are independently molded and then are joined and sealed along a peripheral interface 158 (FIG. 4) creating a cove channel 160 extending along the entire periphery of door 112. A continuous resilient gasket 162 is compressed and inserted into channel 160 for sealing against the bulkhead collar flange as in the prior art. Gasket 162 is captured and retained in channel 160 by the shape of the channel itself and thus requires no adhesives to maintain position. Further, gasket 162 is easily and readily removed and replaced manually without resort to special tools or solvents as in prior art gasket replacement.

Shells 154,156 of improved door 112 are preferably laid up as composite laminates in female molds (as is well known in the prior molding art), which provides a smooth outer surface to each shell. Color may be cast into the surface coat as is known in the molding arts. Useful laminates may include various organic polymers such as, for example, polyesters, epoxies, polyamides, and the like, as well as glass fiber, carbon fiber, and the like.

As used herein, the term "composite" should be taken to mean a three-dimensional combination of at least two materials differing in form or composition with a distinct interface separating the components; composite materials are usually man-made and created to obtain properties that cannot be achieved by the components acting alone. Consistent with this definition of component materials comprehended by the invention are all solid materials that may be, at least, metallic, organic, ceramic, inorganic, organometallic, and the like.

Door shells in accordance with the invention may also be formed of materials, which may be homogeneous or not, by methods other than laminating, for example, by stamping from sheet stock or by injection molding.

Outer door shell 154 is provided with a grab handle 164, which may be raised above the surface of shell 154 or recessed therein. Grab handle 164 preferably is located in the center of the door with respect 165 to ends of the door, as shown, to permit universal use of the door. As noted above, for doors, the handle is preferably equidistant from the door sides, although for hatch covers, the handle preferably is offset from the hinge side to increase opening leverage. The relative lightness of an installed door makes feasible a universal central door handle. Shell 154 is further provided with first and second preformed hinge blades 166,168 having root regions 170 preferably comprising a plurality of laminae that are interleaved with shell laminae as the door is laid up, thereby maximizing the strength of hinge blade attachment to the door.

It is an important feature of the invention that hinge blades 166,168 are spaced apart by a precise distance 170 equal to the distance between the prior art bulkhead hinge pins, and further, that each hinge blade is positioned at a single, predetermined distance 172 from the nearer end 174 of door 112. Precisely positioning the hinge blades at these locations permits door 112 to be used interchangeably in any right-hinged or left-hinged bulkhead opening by simply lowering the hinge blade openings 176,178 over the corresponding bulkhead hinge pins 17 and applying retainers thereto as is known in the prior art. Precision uniformity of hinge blade placement is an inherent and highly-desirable consequence of forming the outer door shell in a mold containing the preformed hinge blades.

When outer and inner shells 154,156 are bonded together, a hermetically sealed chamber 180 is created therebetween such that door 112 is positively buoyant and thus may be used as an emergency flotation device. During the assembly process, chamber 180 may be partially or wholly filled with any desired core filler 182, for example, polystyrene foam or polyurethane foam, to increase door stiffness, strength, and/or fire resistance.

A fully-formed door 112 in accordance with the invention may weigh about 42 pounds, depending upon the materials of construction, whereas a comparable prior art steel door may weigh about 125 pounds. The reduction in weight can increase the working lifetimes of hinge pins, bushings, and thrust washers, as well as making the door easier to open and close. Further, in comparative tests to leakage failure, improved door 112 exceeds the performance of a 10-dog prior art door 12.

When carried aboard ship in an inventory of spare doors, improved door 112 may be stocked without any strikers (not shown) attached, as door 112 may be substituted for any door currently in service, which may require striker patterns for 2, 3, 6, 8, or 10 bulkhead dogs. Metal strikers may be readily bonded by adhesive at the appropriate surface locations when a door is placed into service. Further, seats (not shown) for strikers at all possible striker positions may be cast readily into the surface of outer shell 154 during molding thereof. Of course, door 112 may be provided as manufactured with any predetermined pattern of strikers overmolded in place, as may be desired.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A bulkhead door for providing closing of a bulkhead opening, comprising:

a) an outer shell;

b) an inner shell bonded to said outer shell along mutual peripheral surfaces thereof; and c) first and second hinge blades attached to said outer shell, wherein said first and second hinge blades are spaced apart by a first predetermined distance.

2. A bulkhead door in accordance with claim 1 wherein said first hinge blade is spaced from a first end of said door by a second predetermined distance.

3. A bulkhead door in accordance with claim 2 wherein said second hinge blade is spaced from a second end of said door by a third predetermined distance.

4. A bulkhead door in accordance with claim 3 wherein said second and third predetermined distances are equal.

5. A bulkhead door in accordance with claim 1 further comprising a cove channel formed along said mutual peripheral surfaces and a resilient gasket non-bondedly disposed in said cove channel.

6. A bulkhead door in accordance with claim 1 wherein said inner and outer shells are formed by molding in respective inner and outer shell molds.

7. A bulkhead door in accordance with claim 6 wherein said first and second hinge blades are preformed and are inserted into said outer shell mold for attachment to said outer shell during molding thereof.

8. A bulkhead door in accordance with claim 6 wherein said inner and outer shells are formed of composite materials.

9. A bulkhead door in accordance with claim 8 wherein said materials are selected from the group consisting of metallic, organic, ceramic, inorganic, organometallic, and combinations thereof.

10. A bulkhead door in accordance with claim 1 further comprising a grab handle disposed equidistant from ends of said door.

11. A bulkhead door in accordance with claim 1 further comprising a plurality of strikers disposed on said outer shell.

12. A bulkhead door in accordance with claim 1 wherein an outer surface of at least one of said outer and inner shells is smooth.

13. A bulkhead door in accordance with claim 1 wherein said bulkhead door is a hatch cover.

14. A bulkhead door in accordance with claim 1 wherein said bulkhead door is a scuttle cover.

15. A naval vessel comprising a bulkhead door for providing closing of a bulkhead opening, wherein said bulkhead door includes an outer shell, an inner shell bonded to said outer shell along mutual peripheral surfaces thereof, and first and second hinge blades attached to said outer shell, wherein said first and second hinge blades are spaced apart by a first predetermined distance, and wherein said first hinge blade is spaced from a first end of said door by a second predetermined distance, and wherein said second hinge blade is spaced from a second end of said door by a third predetermined distance, and wherein said second and third predetermined distances are equal.

* * * * *